US007540319B2

(12) United States Patent
Mochizuki et al.

(10) Patent No.: US 7,540,319 B2
(45) Date of Patent: Jun. 2, 2009

(54) HEAT TRANSFER DEVICE

(75) Inventors: Masataka Mochizuki, Tokyo (JP); Eiji Takenaka, Tokyo (JP); Thang Nguyen, Rowville (AU); Massoud Kaviany, Ann Arbor, MI (US)

(73) Assignee: Fujikura Ltd., Tokyo (JP)

( * ) Notice: Subject to any disclaimer, the term of this patent is extended or adjusted under 35 U.S.C. 154(b) by 0 days.

(21) Appl. No.: 11/753,440

(22) Filed: May 24, 2007

(65) Prior Publication Data

US 2007/0235178 A1 Oct. 11, 2007

Related U.S. Application Data

(62) Division of application No. 11/013,342, filed on Dec. 17, 2004, now Pat. No. 7,246,655.

(51) Int. Cl.
*F28D 15/00* (2006.01)
*H05K 7/20* (2006.01)

(52) U.S. Cl. ..... 165/104.26; 165/104.21

(58) Field of Classification Search ..... 165/104.21, 165/104.26, 104.33, 185; 361/700; 257/715
See application file for complete search history.

(56) References Cited

U.S. PATENT DOCUMENTS 2,043,570 A * 6/1936 Baird ..... 62/59
4,838,347 A 6/1989 Dentini et al.
5,308,920 A * 5/1994 Itoh ..... 174/15.2
5,694,295 A * 12/1997 Mochizuki et al. ..... 361/699
6,064,572 A 5/2000 Remsburg
6,085,831 A * 7/2000 DiGiacomo et al. .... 165/104.33
6,474,074 B2 11/2002 Ghoshal
6,550,531 B1 4/2003 Searls et al.
6,588,498 B1 * 7/2003 Reyzin et al. ..... 165/104.33
6,650,544 B1 11/2003 Lai
6,658,861 B1 12/2003 Ghoshal et al.
6,901,994 B1 * 6/2005 Jin-Cherng et al. .... 165/104.26
6,918,431 B2 7/2005 Reyzin et al.
6,957,692 B1 10/2005 Win-Haw et al.
7,246,655 B2 * 7/2007 Mochizuki et al. ..... 165/104.26
7,353,860 B2 * 4/2008 Erturk et al. ..... 165/104.19
2003/0136550 A1 7/2003 Tung et al.
2004/0211549 A1 10/2004 Garner et al.
2005/0011633 A1 * 1/2005 Garner et al. ..... 165/104.26

(Continued)

FOREIGN PATENT DOCUMENTS

CN 1158982 A 9/1997

(Continued)

OTHER PUBLICATIONS

M. Kaviany, et al., "Pool-Boiling CHF Enhancement by Modulated Porous-Layer Coating: Theory and Experiment", International Journal of Heat and Mass Transfer, 2001, pp. 4287-4311.

*Primary Examiner*—Tho v Duong
(74) *Attorney, Agent, or Firm*—Sughrue Mion, PLLC

(57) ABSTRACT

A heat transfer device including a sealed container, a base layer, formed on the bottom face of the container, and a wick is provided. The wick has a plurality of projections protruding upward from the base layer. A fluid is encapsulated in the container. The heat transfer device further includes a guide unit arranged on an inner face of the container, which guides the liquid to the wick.

6 Claims, 9 Drawing Sheets

U.S. PATENT DOCUMENTS

2005/0280996 A1 12/2005 Erturk et al.

FOREIGN PATENT DOCUMENTS

JP 50-4294 1/1975
JP 50-77951 A 6/1975
JP 57-154863 A 9/1982
JP 09-184696 A 7/1997
JP 2000-161879 6/2000
JP 2000-356485 A 12/2000

* cited by examiner

HEAT TRANSFER DEVICE

BACKGROUND OF THE INVENTION

1. Field of the Invention

The present invention deals generally with heat transfer devices for transporting heat by a condensable working fluid, and more specifically with a heat transfer device, in which a liquid phase working fluid is refluxed mainly by gravity, to a heated portion where the heat is transferred from outside.

2. Discussion of the Related Art

As a heat transfer device, heat pipes are well known in the art, which transport heat in the form of latent heat of a working fluid. In the heat pipes, a non-condensable gas is evacuated from an airtight container, and a condensable fluid such as water or hydrocarbon is encapsulated therein. Therefore, if the heat is transported to a part of the heat pipe from outside while cooling another part, the working fluid is vaporized by the transported heat, and the vapor flows to a cooled part where a temperature and a pressure are low. The vapor releases the latent heat outside of the container and then liquefies. The resultant liquid phase working fluid flows back to a so-called "heated portion" where the heat is transmitted from outside.

As described above, the working fluid vapor is transmitted to a heat radiating side by a pressure difference in the container arising from the input and radiation of heat. Meanwhile, a pressure for refluxing the liquid phase working fluid to the heated portion is required so that common heat pipes are adapted to create a capillary pumping. Specifically, thin slits, porous materials or meshes are arranged in the container so as to function as a wick. If the working fluid infiltrating into the wick is evaporated, the meniscus of the working fluid infilling pores in the wick comes down. Consequently, a capillary pumping arises from a surface tension. The condensed working fluid infiltrating into the wick is aspirated to the heated portion side by the capillary pumping thus created at the heated portion, and then flown back to the heated portion where evaporation takes place.

Also, heat pipes, in which the working fluid is refluxed by gravity, are known in the art. The heat pipe of this kind is called a thermosiphon. A structure of the thermosiphon is similar to that of the aforementioned heat pipe but does not comprise the wick. The thermosiphon is used in a gravitational field. In the thermosiphon, a lower end thereof in the direction of gravitational force is the heated portion, and the heat is radiated outside from its upper end. In the thermosiphon, accordingly, a working fluid vaporized by the heat transmitted from outside flows to the upper end where the temperature and the pressure are low in consequence of the outgoing radiation. As a result, at the upper end of the thermosiphon, the heat of the vaporized working fluid is released and the working fluid is condensed. Then, the working fluid is dropped or flown down by gravity, to the heated portion of the lower end of the container. Additionally, the wick may be applied to the container of the thermosiphon in order to disperse the working fluid all over the heated portion.

As described above, in the heat pipe, the working fluid is circulated by a repetition of its evaporation and condensation, therefore, in principle, the heat is transported in the form of latent heat of the working fluid. In order to transport the heat continuously, therefore, ample amount of the working fluid has to be present in the heated portion. In other words, it is necessary to collect the working fluid at the lower end of the container in the thermosiphon. In case that a so-called "reservoir" is heated as the heated portion, pool boiling of the liquid phase working fluid occurs so that the working fluid vaporizes. The working fluid vapor flows upward from the reservoir portion. On the other hand, the working fluid liquefied at the upper part of the container drops or flows down toward the reservoir portion. Namely, the vapor and the working fluid flow in directions opposite to each other to form a counter flow. Thus, there are a number of factors that hinder the evaporation and the flow of the working fluid remains in the traditional thermosiphon. Therefore, there is a need for improvement to enhance the heat transporting capacity.

An art of improving the performance of the thermosiphon is disclosed in "International Journal of Heat and Mass Transfer 44 (2001) 4287-4311" by Kaviany et al. According to the disclosed thermosiphon, a porous layer having a periodically modulated thickness is applied as a wick, to an inner face of the lower part of the container i.e., the heated portion. Specifically, the porous layer is made from particles of several hundred micrometers consolidated by a sintering etc., and a base layer thereof is composed of one or two layers of the sintered particles. On the base layer, there are formed "stacks" (or cones) composed of over ten layers of sintered particles so that the thickness of the porous layer is periodically increases. The stacks are formed into pyramidal shape, which is tapered toward the top.

The container, which has the wick composed integrally of the base layer and the stacks at the bottom, is evacuated and then filled with a proper condensable fluid as the working fluid. Accordingly, the wick is impregnated entirely with the liquid phase working fluid by the capillary pumping. If the heat is transmitted to the bottom of the container under such condition, the heat is transmitted to the working fluid through the wick, and the working fluid is thereby heated and evaporated. The working fluid vapor flows toward the upper portion of the container and then contacts with the container so that the heat is drawn therefrom. Consequently, the working fluid is liquefies and it drops or flows down to the wick. The liquid phase working fluid coming down to the tip of the stack infiltrates into the stack, and forms a liquid film on the surface of the stack by the capillary pumping created at the surface of the stack.

Namely, droplets generated as a result of condensation of the working fluid fall onto the tip of the stack, while the liquid phase working fluid is pumped up by the capillary pumping from the base layer to the stack. Also, the heat transmitted to the bottom portion of the container is further transmitted to the stack from the base layer and the bottom side of the stack. Hence, the evaporation of the working fluid takes place principally at the portion of an outer circumferential face of the stack in the vicinity of a base portion. Consequently, the vapor flows upward through interspaces (i.e., valleys) between the individual stacks.

In other words, the working fluid is evaporated from the thin liquid film of the working fluid formed on the outer circumferential face of the base portion of the stack, and the liquid phase working fluid is supplied to the evaporating portion by the capillary pumping generated at the porous structured stack. Therefore, the liquid phase working fluid can be evaporated efficiently without a choking of the liquid flow. Moreover, the working fluid vapor ascends through the so-called "valley portion" between the stacks so that it rarely conflicts with the liquid phase working fluid flowing back to the wick. As a result, the circulation movement of the working fluid is smoothened so that the heat transporting characteristics is thereby improved.

In the aforementioned thermosiphon having the wick comprising stacks, the working fluid is evaporated principally at the lower part of the outer circumferential tapered face of the stack. Hence, there is a need for forming the thin liquid film of the working fluid stably on the tapered outer circumferential face of the stack. However, according to the prior art, the reflux of the working fluid to the stacks mainly depends on free-fall from a heat radiating portion (or a condensing portion) formed at the upper part of the container and the capillary pumping generated in the wick. For this reason, in case the thermosiphon is inclined, or in case a heat flux is large, a flow rate of the working fluid back to the stacks becomes insufficient and this shortage makes it difficult to form the liquid film of the working fluid on the outer circumferential face of the stack. As a result of this, a heat transporting performance may be degraded.

SUMMARY OF THE INVENTION

It is an object of the present invention to improve heat transporting characteristics of a heat transfer device, in which a wick having porous structured stacks or cones, is arranged at the bottom portion of a container wherein a fluid is encapsulated. More specifically, the object of the invention is to flow the fluid back to stacks or cones intensively.

An exemplary heat transfer device according to the present invention comprises a sealed container in which a condensable working fluid is encapsulated. The fluid evaporates when it is heated, and condenses when heat is removed therefrom. At the bottom of the container, i.e., a lower side of the container when it is under operation, there is arranged a wick which has stacks or cones (hereinafter, called "projections") protruding upward from a porous structured base layer contacting with a bottom face of the container. The container also comprises a guide unit for guiding the fluid to the projections of the wick. According to an exemplary aspect of the present invention, the container has an upper face positioned above the projections of the wick, and the downwardly protruding projections which guide the fluid to the wick are arranged on the upper face portion.

The wick may comprise projections which are spread all over a bottom face of the container, or may comprise projections concentrated on the portion of the container where heat input is large. Additionally, the protrusions may be shaped into an arbitrary shape, such as a cylinder, a cone, a pyramid, or another shape as would be understood by one of skill in the art.

The wick and the base layer may be formed integrally. For example, particles of several hundred micrometers in diameter may be consolidated in one or more layers, forming a porous structured base layer, and the particles may be heaped up and consolidated at predetermined portions in the base layer thereby forming the projections of the wick. In such a case, the height of the protrusions may vary from one to a few millimeters.

The devise may be arranged such that the downwardly extending projections of the guide unit are substantially aligned with the projections of the wick. However, the downwardly extending projections may take any shape as understood by one of skill in the art so that they protrude downwardly from the upper face of the container. In order to facilitate dropping of the fluid onto the wick, the projections may have a tapered shape with a pointed leading end (i.e., a lower end), or a needle shape. In addition, the leading end (i.e., the lower end) of the downwardly extending projections may contact with the upper ends of the projections of the wick.

As described above, one of the objects of the present invention is to facilitate the reflux of the fluid to the projections of the wick. For this purpose, according to one exemplary aspect of the heat transfer device of the invention, the upper face of the container, where the downwardly extending projections of the guide unit are formed, and the bottom face of the container on which the wick is formed may be inclined downward in order to guide the fluid to the guide unit and the wick.

The external side of the bottom face of the container is in contact with a heat source. Specifically, the heat is transmitted to the wick on the bottom face of the container so that the fluid which is absorbed in the wick is evaporated. The evaporation of the fluid takes place principally at a liquid film formed on the lower side of the outer circumferential face of the projections of the wick (i.e., the portions of the projections which are in the vicinity of the base layer). Accordingly, the evaporated fluid ascends between the individual projections and contacts with the upper face side of the container, i.e., a heat radiating portion, so that latent heat is radiated therefrom and the fluid condenses. Thereafter, the fluid is guided by the guide unit to the wick. For example, the fluid may be guided downwardly by the projections arranged on the upper face of the container, and then dropped from the leading end (i.e., lower end) of the projections. The projections of the guide unit may be arranged above the projections of the wick, so that the liquid phase working fluid dropping from the leading end of the projections is fed to the leading end of the projections of the wick. Then, the liquid phase fluid flows down the projections of the wick. Meanwhile, since the projections of the wick are porous structures, the fluid is distributed entirely in the protrusions and the wick by the capillary pumping. For this reason, the fluid flows back to the projections of the wick sufficiently, and the vapor flow and the reflux of the fluid will not collide against each other as a counterflow. Therefore, the heat transport is carried out efficiently so as to attain a heat transfer device in which has excellent heat transport performance. In particular, if the upper face of the container and the lower face of the container, around the projections of the guide unit and the wick, respectively, are inclined toward the projections, it is possible to concentrate the widely dispersing fluid vapor on the wick. As a result, the reflux of the fluid is facilitated so that the heat transport characteristics can be improved.

BRIEF DESCRIPTION OF THE DRAWINGS

These and other features, aspects, and advantages of the present invention will become better understood with reference to the following description and accompanying drawings, which should not be read to limit the invention in any way, in which.

DETAILED DESCRIPTION OF THE INVENTION

Figure 1:
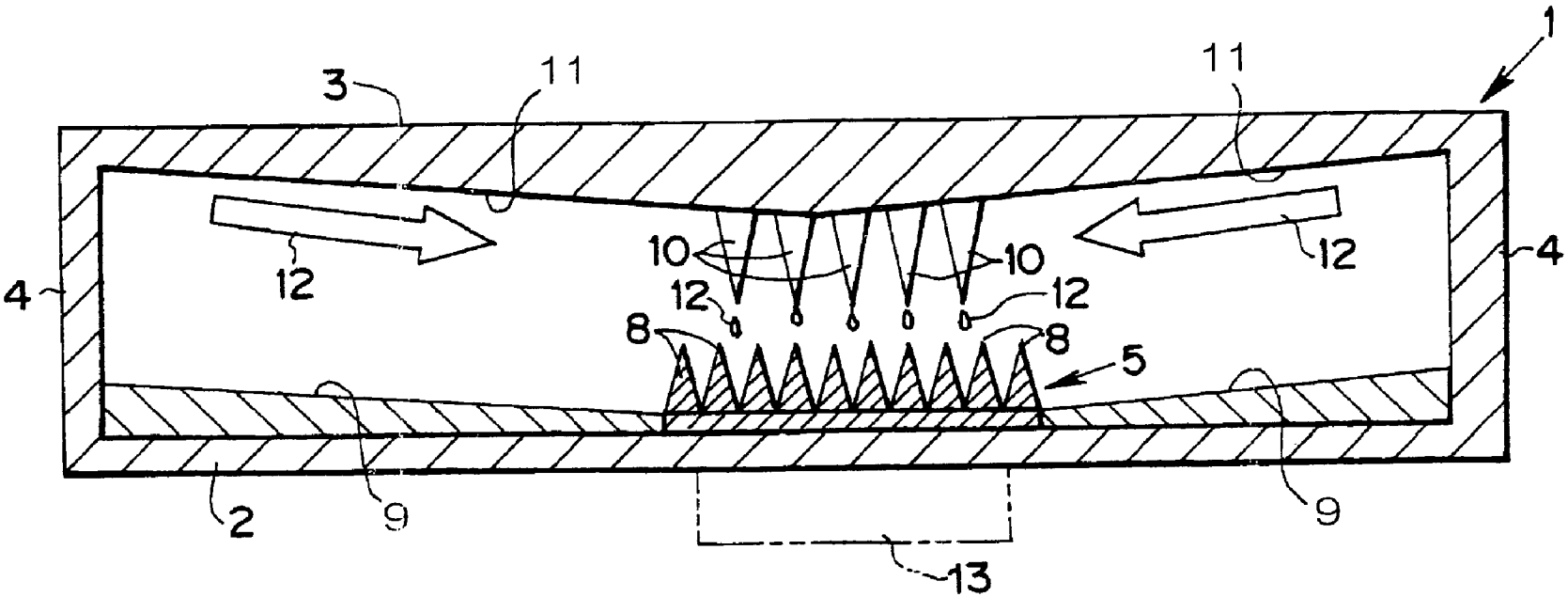
FIG. 1 is a cross-sectional view schematically showing one example of a heat transfer device according to the invention.

Hereinafter, exemplary embodiments of the present invention will be described. FIG. 1 shows one example of a heat transfer device according to the invention. The heat transfer device comprises a thin container 1 having a rectangular cross-section. The container 1 is made of a metal having high heat conductivity such as copper, and has a sealed structure such that a bottom plate 2 and an upper plate 3, having large planar dimensions, are combined with side plates 4 having a short height. A porous structured wick 5 is placed in the center of an inner face of the bottom plate 2.

Figure 2:
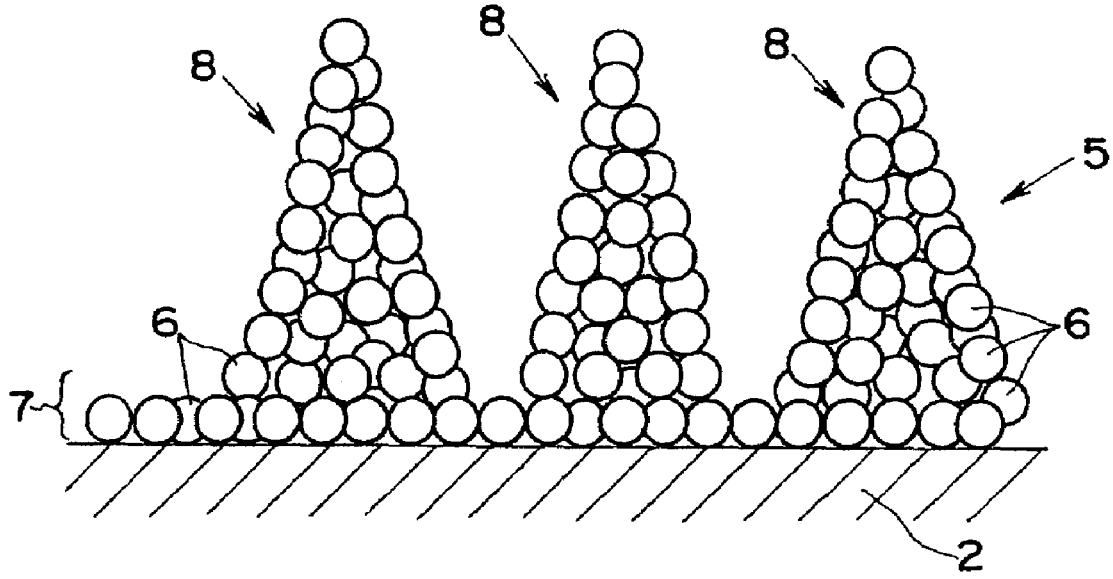
FIG. 2 is schematic view showing projections of a wick in an enlarged scale.

A structure of wick 5 is illustrated in FIG. 2 in an enlarged scale. The wick 5 is formed into a predetermined shape by consolidating particles 6. The particles 6 have excellent hydrophilicity with a fluid, and are composed of a material which does not react with the working fluid, e.g., a copper particle of several hundred micrometers (e.g., around 200 μm) diameter. Those particles 6 are consolidated by sintering or the like, so as to form the wick 5.

According to an exemplary aspect of the present invention, the thickness of the wick 5 is not constant and the upper face thereof is rugged. Specifically, a substantially flat base layer 7 is formed by consolidating the above-mentioned particles 6 into one or more layers. A base layer 7 is attached to the inner face of the bottom plate 2 (i.e., an upper face in FIG. 1). At predetermined portions of the base layer 7, the particles 6 are heaped up and consolidated integrally with the base layer 7 by a sintering etc. Accordingly, the thickness of the wick 5 is thicker at those portions. The portions where the particles 6 are heaped up correspond to projections 8 of the wick of the present invention. Those portions may be described as "stacks" or "cones". The projections 8 may be shaped into an arbitrary shape like a cylinder, cone, or pyramid as would be understood by one of skill in the art. In case of a conical shape, for example, the height of each projections may be around 1.8 mm, and an outer diameter of a base portion of each projections may be around 0.8 mm. Additionally, the projections 8 may be arranged at either regular or irregular intervals.

In the example illustrated in FIG. 1, the wick 5 is arranged only in the center area of the inner face of the bottom plate 2, and an area around the wick 5 is an inclined face 9, which is downwardly inclined toward the wick 5. The inclined face 9 may be formed by varying a thickness of the bottom plate 2 itself, or by providing a plate material, which has an inclined face on its upper face, in the container 1.

Further, in this example, in the center area of an inner face of the upper plate 3, i.e., above the projections 8, there are arranged a plurality of downwardly extending projections 10 projecting toward the projections 8 of the wick. The projections 10 extend downwardly from the inner face (i.e., lower face in FIG. 1) of the upper plate 3 in order to flow or drop the fluid onto the projections 8 of the wick. The projections 10 may be shaped into an arbitrary shape, e.g., a downwardly pointed tapered shape, or a column shape, as would be understood by one of skill in the art. However, it is easier for the fluid to flow down the projections 9, when the lower ends thereof are pointed. Additionally, the projections 10 may be arranged to align substantially with the projections 8 of the wick.

The projections 10 have to be positioned in the center of the inner face (i.e., the lower face) of the upper plate 3 so as to be confronted with the protrusions 8 on the bottom plate 2. The status is shown in FIG. 1. In such a construction, a face outside of a predetermined area where the projections 10 are arranged may be inclined downwardly toward the projections 10. This inclined area is an inclined face 11. The inclined face 11 may be formed by varying a thickness of the upper plate 3 itself, or by providing a plate material which has an inclined face on its lower face, in the container 1.

Inside of the container 1 having a wick 5, the air is expelled, and a fluid 12 is encapsulated. The fluid 12 is a liquid for transporting heat in the form of latent heat, which circulates by a repetition of its evaporation and condensation. As the fluid 12, a condensable fluid, such as water, pentane, alcohol or the like, as would be understood by one of skill in the art, can be used.

In the aforementioned exemplary heat transfer device, the bottom plate 2 of the container is a heated portion (or a heat inputting portion), and the upper plate 3 is a condensing portion (or a heat radiating portion). In case of cooling an electron device 13, for example, as shown in FIG. 1, the electron device 13 is contacted with the center part of a lower face of the bottom plate 2 in a heat transmittable manner. The heat is radiated intensively by cooling an upper face (i.e., an outer face) of the upper plate 3, or by installing a heat sink (heat sink not shown) thereon.

The fluid 12 migrates to the bottom of the container 1 by gravity; however, since the inclined face 9 is formed at the bottom of the container 1, the fluid flows toward the wick 5 and infiltrates into the wick 5. The wick 5 is a porous structure made of the sintered particles 6; therefore, capillary pumping is generated on the surface of the wick 5 and a thin liquid film of the fluid is formed on the outer circumferential face of the projections 8.

The heat generated by the electron device 13 is transmitted to the 1 fluid through the bottom plate 2 and the wick 5, and the fluid is thereby heated. This results in the evaporation of the fluid 12 at the outer circumferential face of the projections 8, especially at around the base portion thereof. In this case, the fluid 12 is evaporated from the condition of a thin liquid film, so that the heat transfer to the fluid as well as the evaporation of the fluid can be achieved efficiently. Then, the heated fluid vapor flows upward through the space between the individual projections 8 (i.e., valley portions). Concurrently, the condensed, cooled fluid is spread over the outer surface of the projections 8 from the tip by gravity or capillary pumping. Hence, the vapor flow and the liquid flow of the fluid do not collide directly with each other. This reduces the resistance against the vapor flow, and the resistance against the flow of the refluxing fluid. Consequently, the heat transporting capacity is enhanced and the heat transporting efficiency is improved.

When the fluid vapor reaches the upper plate 3 as the heat radiating portion, the heat is removed from the fluid vapor by the upper plate 3 so that it is condensed, and the heat is dissipated outside from the upper plate 3. Such condensation of the fluid 12 takes place all over the inner face (i.e., the lower face) of the upper plate 3 including over the projections 10. The condensed fluid 12 drops directly from the inner face of the upper plate 3 or flows down the inclined face 11 formed on the inner face of the upper plate 3 toward the projections 10. Accordingly, the fluid on the inner face side of the upper plate 3 is concentrated on the projections 10. Further, the projections 10 extend downwardly from the inner face of the upper plate 3, so that the fluid flows down the projections 10 and then drops from the leading end (i.e., the lower end) of the projections 10. Since the projections 8 of the wick are substantially aligned with the projections 10, the fluid dropped from the projections 10 is eventually fed to the tips of the projections 8 of the wick.

Accordingly, the aforementioned inclined faces 9 and 11, and the projections 10 correspond to an exemplary guide unit of the invention.

The condensed fluid 12 is thus transmitted back to the projections 8 of the wick in a concentrated form. The upper ends of the projections 8 of the wick and the lower ends of the projections 10 may be close to each other so that the fluid can be transmitted back certainly and promptly to the projections 8 of the wick where the evaporation of the fluid 12 takes place. Accordingly, a shortage and a depletion of the fluid will not occur at the wick 5 and its projections 8 even if the container 1 is inclined and an input amount of the heat increases. As a result, the heat transporting capacity is enhanced and the heat transporting efficiency is improved.

Next, another exemplary embodiment of the invention will be described. According to the exemplary heat transfer device illustrated in FIGS. 3 and 4, the downwardly extending projections 10 are formed into rectangular columns and function as the fluid guide unit for guiding the fluid resulting from the condensation of the fluid vapor, to the projections 8 of the wick. The projections 10 are arrayed in a plurality of lines at regular intervals. The remainder of the construction of the example shown in FIGS. 3 and 4 is similar to that of the example shown in FIGS. 1 and 2.

Figure 3:
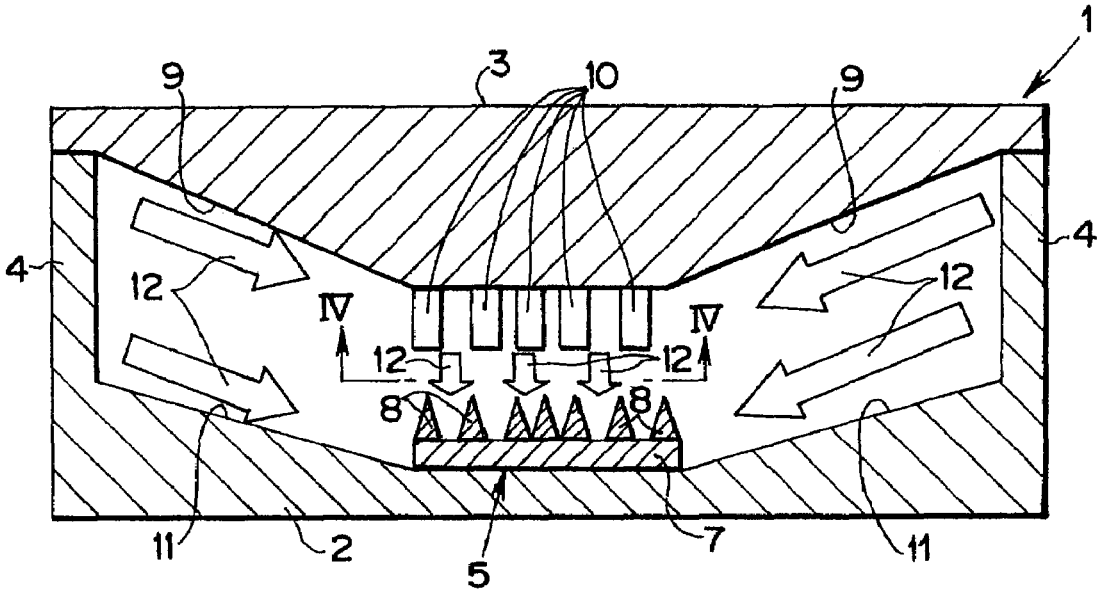
FIG. 3 is a cross-sectional view schematically showing another example of a heat transfer device according to the invention.
Figure 4:
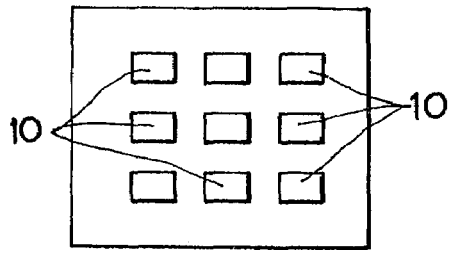
FIG. 4 is a perspective view from IV-IV line in FIG. 3.

According to the construction shown in FIGS. 3 and 4, the projections 10 can be formed by cutting a predetermined metallic material. This facilitates the manufacturing and processing of the device.

Figure 5:
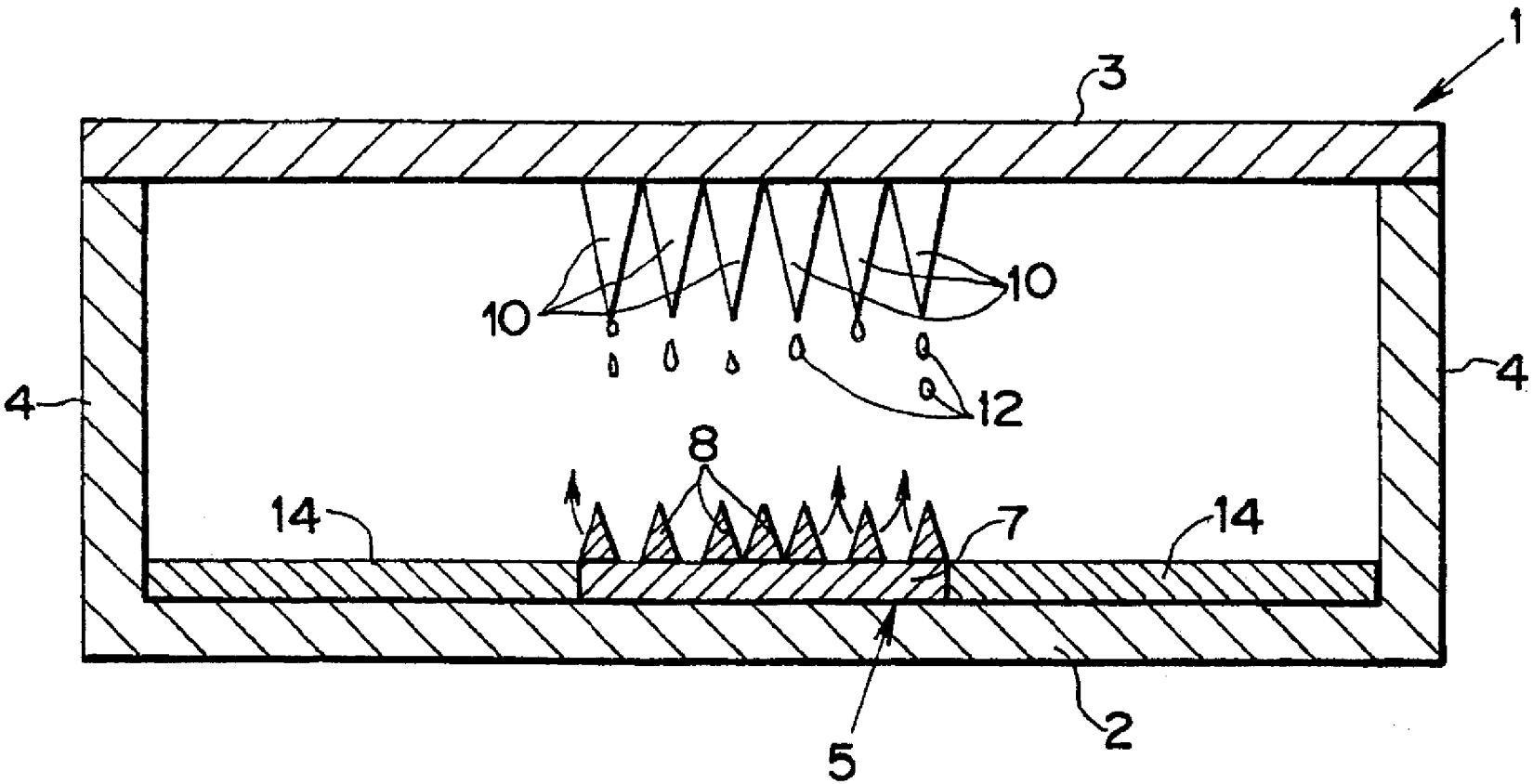
FIG. 5 is a cross-sectional view schematically showing another example of a heat transfer device according to the invention.

According to the exemplary the heat transfer device illustrated in FIG. 5, the bottom face of the container around the wick 5 is flat, and a sheet-like wick 14 is placed on this flat face and communicates with or contacts the wick 5. The sheet-like wick 14 is composed of a porous sheet material made of sintered particles such as metallic particles etc., or of a mesh material, or the like as would be understood by one of skill in the art. Flow paths are formed in the sheet-like wick 14 for directing the fluid back to the wick 5 having the projections 8. Therefore, desirably, the sheet-like wick 14 has a larger void rate than that of the wick 5. Unlike the aforementioned embodiment, the inner face of the upper plate 3 of the current exemplary embodiment is flat, and a plurality of projections 10 extend downwardly from a position on the upper face of the container aligned with the wick 5.

In the exemplary heat transfer device illustrated in FIG. 5, therefore, the fluid resulting from the condensation of the vapor is guided by the projections 10 to drop on the projections 8 of the wick 5, and the fluid dropped from the upper plate 3 to the sheet-like wick 14 is migrated intensively by the capillary pumping of the sheet-like wick 14, toward the wick 5 or the projections 8 where the evaporation of the fluid takes place. Accordingly, the sheet-like wick 14 may be a part of the guide unit of the invention.

Thus, the fluid can be directed back to the projections 8 of the wick where the evaporation of the fluid takes place. Therefore, as with the heat transfer devices of the above-mentioned embodiments, the heat transporting capacity is enhanced and the heat transporting efficiency is improved.

Figure 6:
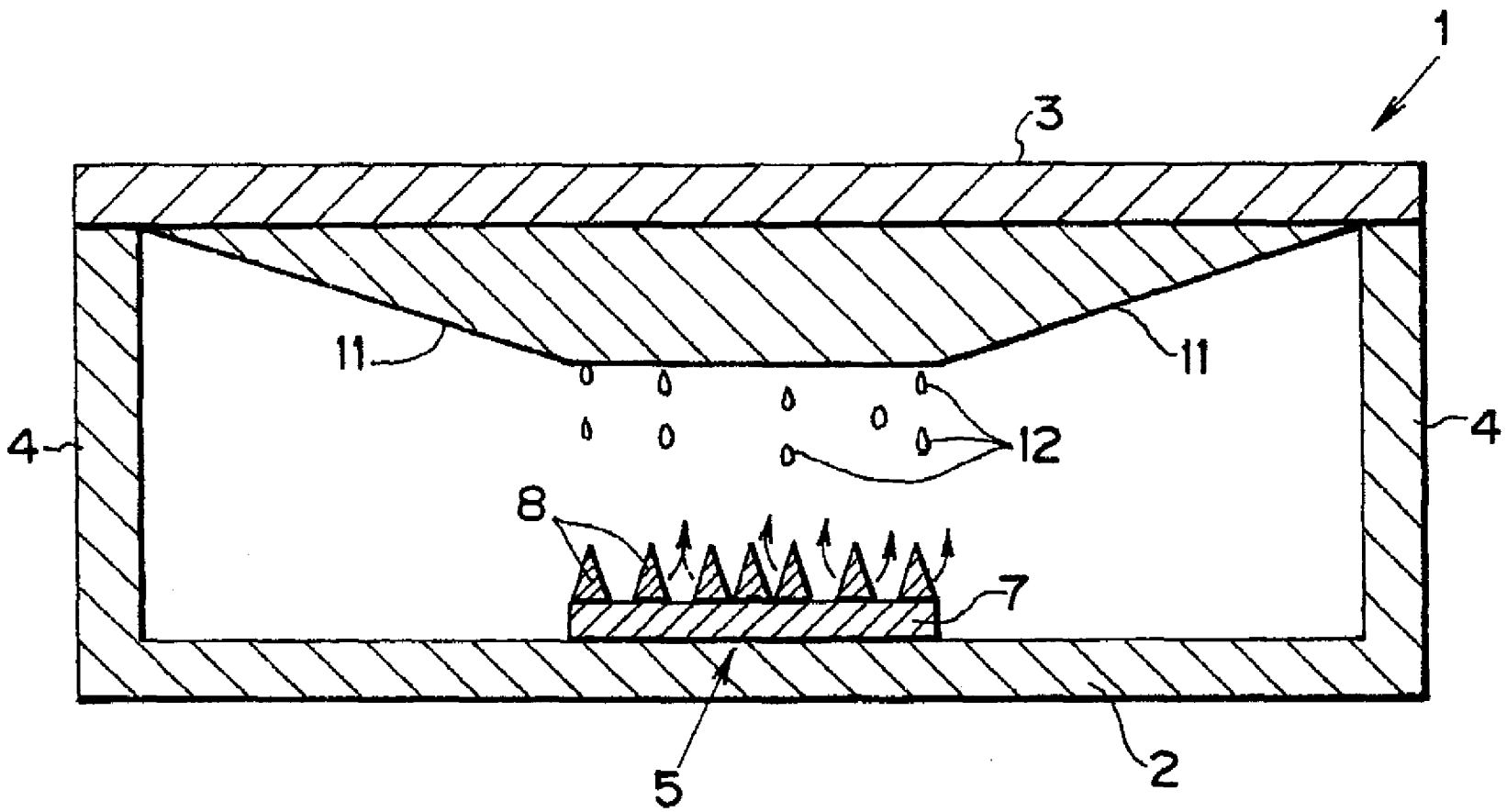
FIG. 6 is a cross-sectional view schematically showing another example of a heat transfer device according to the invention.

Although FIG. 5 shows an example in which the inclined face is eliminated and the projections 10 are provided in the upper plate 3, in the example illustrated in FIG. 6, the projections are eliminated and the inclined face 11 is provided in the upper plate 3. In the example illustrated in FIG. 6, the wick 5 having the projections 8 is arranged in the center of the inner face of the bottom plate 2. The area around of the wick 5 is flat and no inclined face or other wick is provided thereon.

Further, according to the exemplary embodiment of FIG. 6, the portion of the inclined face 11 on the upper plate 3 which is substantially aligned with the wick 5 is the lowest portion of the inclined face 11. Accordingly, the fluid, condensed by contact with the upper plate 3, flows down the inclined face 11 toward its lowest portion, and then drops therefrom to the projections 8 of the wick 5. Namely, the inclined face 11 may be a part of an exemplary guide unit of the invention. Since the inclined face 11 helps to direct the fluid back to the projections 8 of the wick 5 where the evaporation of the working fluid takes place, the heat transporting capacity is enhanced and the heat transporting efficiency is improved, as with the heat transfer devices of the above-mentioned exemplary embodiments.

Figure 7:
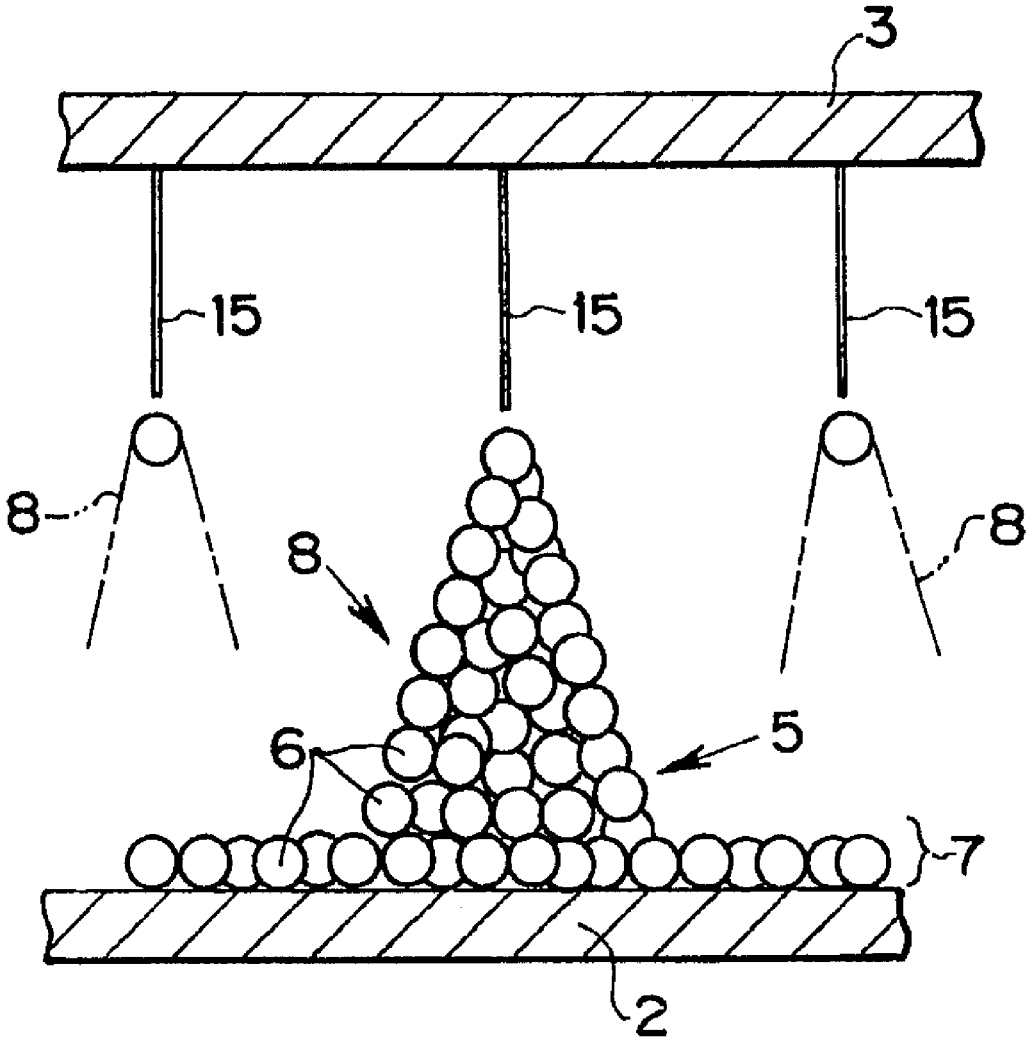
FIG. 7 is a partial diagrammatic view showing an example of using a thin wire as a projection.
Figure 8:
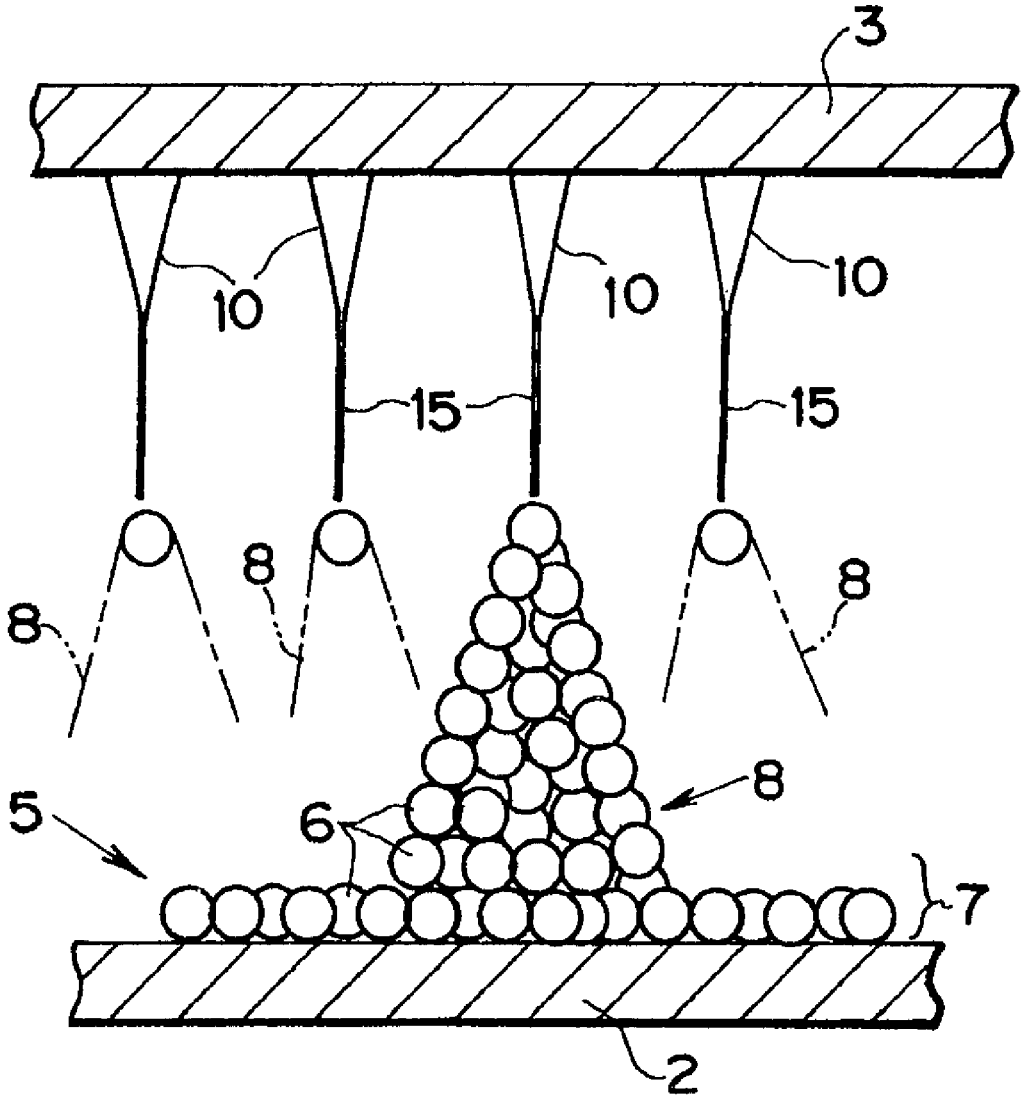
FIG. 8 is a partial diagrammatic view showing an example of using a thin wire in addition to a projection.

Moreover, according to another exemplary embodiment of the present invention, a metal wire such as a needle, or a thin string such as a carbon fiber, a synthetic fiber, and so on can be adopted instead of or in addition to the aforementioned projections 10. FIG. 7 shows an example in which thin wires 15 are employed as the projections of the guide unit for guiding the fluid. The thin wires 15 are installed directly on the flat inner face of the upper plate 3 and dangle therefrom. Also, FIG. 8 shows an example in which the thin wires 15 are installed to dangle from leading ends of the projections 10 formed on the flat inner face of the upper plate 3. Here, in any of the examples illustrated in FIGS. 7 and 8, the leading ends (i.e., the lower ends) of the thin wires 15 come close to or contact with the tips of the projections 8 of the wick 5.

In case of the constructions illustrated in FIGS. 7 and 8, the fluid, which is condensed by the contact with the upper plate 3, is directed to the projections 8 by the thin wires 15. Therefore, it is possible to return the fluid to the projections 8 where the evaporation of the working fluid takes place. In other words, the thin wires 15 may form a part of the guide unit of the invention.

According to one exemplary embodiment of the present invention, a porous sheet or a mesh sheet, each comprising pores, may be provided on the inner face of the upper plate 3 of the container. Those pores communicate with each other so that they function as flow paths. Accordingly, the use of a porous sheet or a mesh sheet would cause the fluid to be to the protrusions 8 of the wick 5. In the example illustrated in FIG. 9, a porous structured sheet material 16 is arranged on the inner face of the upper plate 3, and a plurality of projections 17 projecting towards the projections 8 of the wick are formed on the sheet material 16. The leading ends (i.e., the lower ends) of the projections 17 come close to or contact with the tips of the projections 8 of the wick 5.

Consequently, the fluid condensed at the upper plate 3 is absorbed into the sheet material 16, and is directed to the projections 17 by the capillary pumping generated in the sheet material 16. Then, the fluid is fed to the projections 8 of the wick 5 from the leading ends of the projections 17. Specifically, the sheet material 16, having the projections 17 formed thereon, may form a part of the guide unit of the invention. As with the heat transfer devices of the above-mentioned exemplary embodiments, therefore, the heat transporting capacity can be enhanced and the heat transporting efficiency can be improved, by directing the fluid back to the projections 8 of the wick where the evaporation takes place, by means of the sheet material 16.

Figure 9:
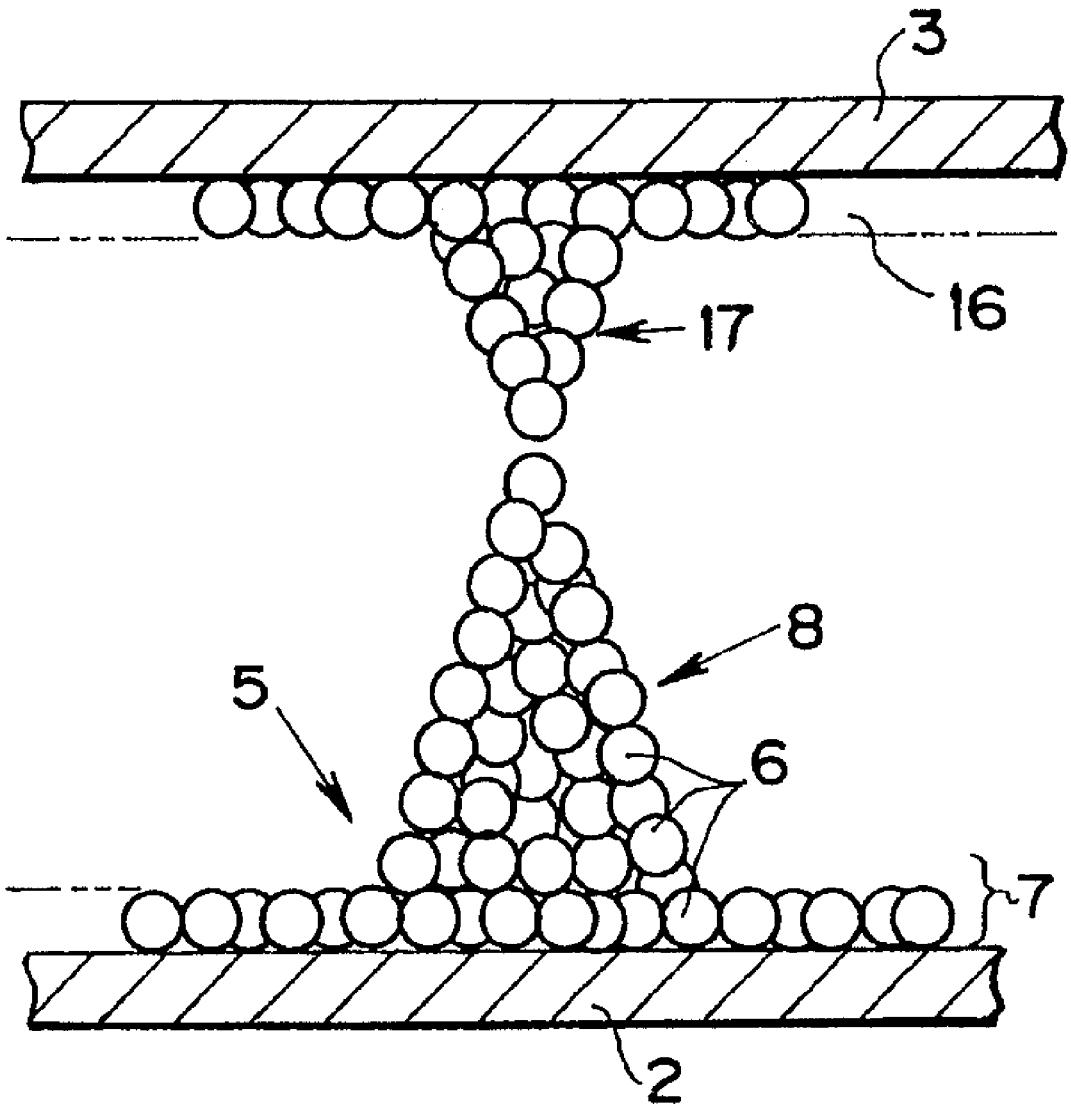
FIG. 9 is a partial diagrammatic view showing an example of arranging a porous structured sheet material on an inner face of an upper plate.

In the construction illustrated in FIG. 9, it is also possible to connect or integrate the projections 17 of an upper side and the projections 8 of the wick. In such a construction, the wick 5 of the lower side and the sheet material 16 of the upper side are in contact with each other. Consequently, the fluid is directed bi-directionally, i.e., from the wick 5 to the sheet material 16, and from the sheet material 16 to the wick 5, by the capillary pumping generated in the wick 5 and the sheet material 16. Thus, the flow direction of the fluid is not limited in this construction. Therefore, a heat transfer device according to this exemplary embodiment, in which the wick 5 and the sheet material 16 are in contact with each other, can be used reversibly.

Further, although the wick 5 having the projections 8 is provided only in the center of the inner face of the bottom plate 2 in the aforementioned embodiments, it is also possible to arrange a wick of this kind over a larger portion or over the entire surface of the inner face of the bottom plate.

Figure 10:
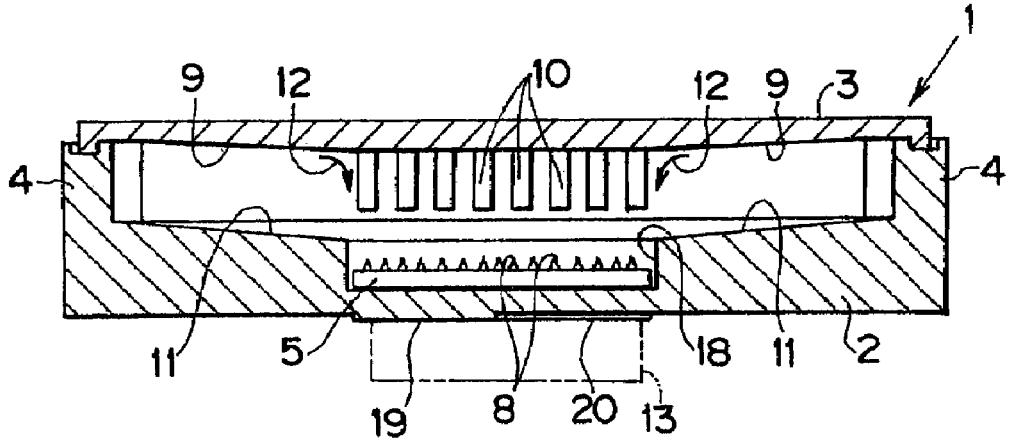
FIG. 10 is a cross-sectional view schematically showing another example of a heat transfer device according to the invention.
Figure 11:
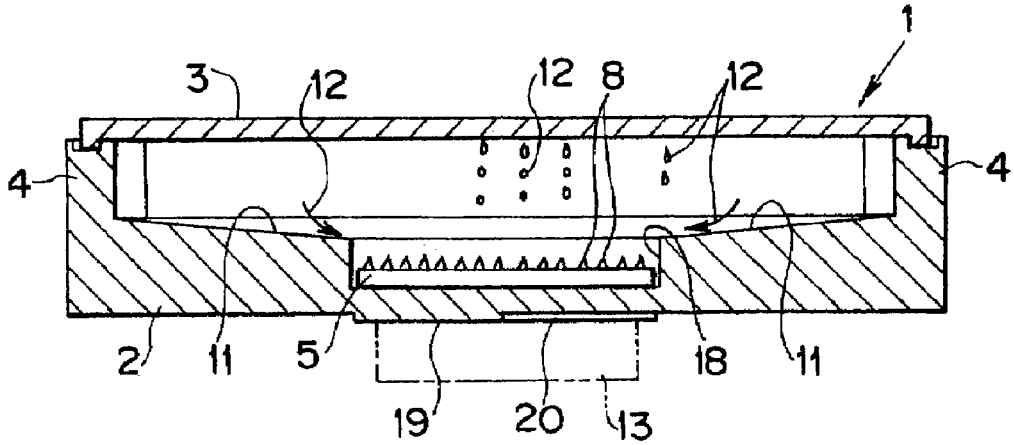
FIG. 11 is a cross-sectional view schematically showing another example of a heat transfer device according to the invention.

FIGS. 10 and 11 show an exemplary construction of the present invention in which the wick 5 having the projections 8 is aligned with a positioning of an object to be cooled, such as an electronic element 13. In the exemplary heat transfer device illustrated in FIG. 10, a part of the construction shown in FIGS. 3 and 4 is modified, and a depressed portion 18 is formed in the center of the inner face of the bottom plate 2. The outline of the depressed portion 18 may be an arbitrary shape, such as a rectangular shape or a round shape, as would be understood by one of skill in the art. The bottom face of the depressed portion 18 is flat and the wick 5, having the projections 8, is arranged thereon. In order to reduce thermal resistance between the wick 5 and the bottom face of the depressed portion 18, the wick 5 and the bottom face of the depressed portion 18 may be integrated by sintering the wick 5 onto the bottom face of the depressed portion 18.

Further, the area around the depressed portion 18 may be the inclined face 11, which is inclined toward the depressed portion 18.

Moreover, a pedestal portion 19 is formed in the center of the bottom face of the bottom plate 2. The pedestal portion 19 is arranged in accordance with the positioning of the depressed portion 18. The pedestal portion 19 has an outline generally identical to that of the depressed portion 18, and it is formed by a slight protrusion of the center portion of the lower face of the bottom plate 2. An object to be cooled, such as the electron device 13, is fixed onto the pedestal portion 19 in a heat transmittable manner. From an approximately central portion of the pedestal portion 19, there is formed a slit 20 which extends linearly toward a predetermined side face of the pedestal portion 19. the remaining construction of the device illustrated in FIG. 10 is similar to that in FIGS. 3 and 4, so further description will be omitted by allotting common reference numerals to FIG. 10.

According to the heat transfer device illustrated in FIG. 10, therefore, the heat of the electron device 13 contacted with the pedestal portion 19 is transmitted to the wick 5, so that the fluid is evaporated from the surface of the projections 8 of the wick, to transport the heat in the form of latent heat. The heat is drawn from the fluid vapor by contact with the upper plate 3 so that it is condensed. A part of the fluid drops directly on the bottom plate 2 and is guided by the inclined face 11 to flow toward the wick 5 having the protrusions 8. Meanwhile, the other part of the fluid flows down the inclined face 9 toward the projections 10, and then drops from the projections 10 onto the wick 5 having the projection 8. Thus, the fluid is guided to concentrate on the wick 5, so that the heat transporting capacity can be enhanced and the heat transporting efficiency can be improved. In the construction of the heat transfer device illustrated in FIG. 10, accordingly, the inclined face 9 and the projections 10 of the upper plate 3 side, and the inclined face 11 of the bottom plate 2 side may form the guide unit of the invention.

Furthermore, in the exemplary heat transfer device illustrated in FIG. 11, a part of the construction shown in FIG. 10 is modified. According to this construction, the inner face of the upper plate 3 is flat to eliminate the aforementioned projections 10 and the inclined face 9. The remainder of the construction illustrated in FIG. 11 is similar to that in FIG. 10, so further description will be omitted by allotting common reference numerals to FIG. 11.

In the exemplary heat transfer device illustrated in FIG. 11, the fluid vaporized by the heat of the electron device 13 is condensed by contact with the upper plate 3, and eventually, the heat is transported in the form of latent heat. Then, the fluid drops directly from the inner face of the upper plate 3 or flows down the inner face of a sidewall 4 toward the bottom plate 2, and after this, flows down the inclined face 11 formed on the inner face of the bottom plate 3 to the depressed portion 18. In short, the fluid is guided to flow back to the depressed portion 18. Therefore, the heat transporting capacity is enhanced and the heat transporting efficiency is improved. In the construction of the heat transfer device illustrated in FIG. 11, accordingly, the inclined face 11 of the bottom plate 2 may form the working fluid guide unit of the invention.

Lastly, according to the present invention, the bottom plate and the upper plate can be constructed variedly as thus has been described, and those constructions of the bottom plate and the upper plate may be combined arbitrarily.

Although the above exemplary embodiments and aspects of the present invention have been described, it will be understood by those skilled in the art that the present invention should not be limited to the described exemplary embodiments and aspects, but that various changes and modifications can be made within the spirit and scope of the present invention.

What is claimed is:

1. A heat transfer device comprising;

a sealed container;

a fluid, which evaporates when heated and which condenses when heat is removed therefrom, encapsulated in the sealed container;

a porous base layer disposed on an interior, bottom face of the container;

a wick comprising a plurality of projections protruding upwardly from the base layer;

a guide unit, comprising a plurality of thin strings which hang from an interior, upper face of the container, which guides fluid to the wick; and a plurality of tapered projections, each having a pointed leading end and extending downwardly from the interior, upper face of the container; wherein the plurality of thin strings hang from the leading ends of the plurality of tapered projections.

2. The heat transfer device according to claim 1, wherein the base layer comprises particles arranged as a substantially flat plate.

3. The heat transfer device according to claim 1, wherein the plurality of projections each comprise particles arranged into a heaped structure.

4. The heat transfer device according to claim 1, wherein the base layer comprises a porous structure comprising particles arranged as a substantially flat plate; and wherein the plurality of projections each comprise particles arranged into a heaped structure.

5. A heat transfer device comprising:

a sealed container;

a fluid, which evaporates when heated and which condenses when heat is removed therefrom, encapsulated in the sealed container;

a porous base layer disposed on an interior, bottom face of the container;

a wick comprising a plurality of projections protruding upwardly from the base layer; and a guide unit, disposed on an interior face of the container, which guides fluid to the wick, the guide unit comprising a porous structure which creates a capillary pumping, and which is disposed around the wick and communicates with the wick;

a plurality of tapered projections, each having a pointed leading end and extending downwardly from the interior, upper face of the container; and a plurality of thin strings which each hang from one of the plurality of tapered projections.

6. The heat transfer device according to claim 5, wherein the plurality of projections each comprise particles arranged into a heaped structure.

* * * * *